US006522847B2

(12) United States Patent
Nanjo

(10) Patent No.: US 6,522,847 B2
(45) Date of Patent: Feb. 18, 2003

(54) IMAGE FORMING APPARATUS CAPABLE OF EFFICIENTLY REMOVING OZONE WITHOUT REQUIRING AN INCREASE IN EXTERNAL SIZE

(75) Inventor: Yoshihiro Nanjo, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/817,462

(22) Filed: Mar. 26, 2001

(65) Prior Publication Data

US 2001/0026702 A1 Oct. 4, 2001

(30) Foreign Application Priority Data

Mar. 29, 2000 (JP) ..... 2000-091381

(51) Int. Cl.[7] ..... G03G 21/20
(52) U.S. Cl. ..... 399/92; 399/93
(58) Field of Search ..... 399/91, 92, 93, 399/98

(56) References Cited

U.S. PATENT DOCUMENTS 5,038,174 A * 8/1991 Kato et al. ..... 399/92

6,141,512 A * 10/2000 Nagano et al. ..... 399/92

* cited by examiner

*Primary Examiner*—Hoan Tran
(74) *Attorney, Agent, or Firm*—Frishauf, Holtz, Goodman & Chick, P.C.

(57) ABSTRACT

An image forming apparatus includes an outer housing having an external communication opening, a transfer unit for transferring a recording medium from a lower portion of the housing to an upper portion thereof, an image forming unit, having a corona discharge member, for forming an image on the recording medium transferred with the transfer unit, a passage body extending from the vicinity of the image forming unit to the communication opening of the housing, and having an air inlet port opened in the vicinity of the image forming unit and an air ejection port opened at the communication opening, and an air transferring device provided in the passage body for sucking air into the passage body through the air inlet port and ejecting air to the external communication opening of the housing from the air ejection port of the passage body.

26 Claims, 2 Drawing Sheets

IMAGE FORMING APPARATUS CAPABLE OF EFFICIENTLY REMOVING OZONE WITHOUT REQUIRING AN INCREASE IN EXTERNAL SIZE

CROSS-REFERENCE TO RELATED APPLICATIONS

This application is based upon and claims the benefit of priority from the prior Japanese Patent Application No. 2000-091381, filed Mar. 29, 2000, the entire contents of which are incorporated herein by reference.

BACKGROUND OF THE INVENTION

This invention relates to an image forming apparatus for forming an image by means of electrophotographic method on a recording medium moving in a vertical direction.

The image forming apparatus of this kind is used, for example, in a facsimile machine or a copying machine, or is used as a printer. FIG. 4 is a view schematically showing a vertical section of a conventional image forming apparatus which is constituted as a printer.

The conventional printer shown in FIG. 4 is detachably provided with a tray 14 for a recording medium at a predetermined position of a lower end portion of an inner space of an outer housing 10. The tray 14 for the recording medium holds a plurality of ordinary plain paper sheets each having a predetermined size as a recording medium in a mutually laminated state. In the inner space of the outer housing 10, there are further arranged a pick-up mechanism 16 for picking up one after another a plurality of paper sheets 12 in the tray 14 at an upper end thereof, and a transfer unit 20 for transferring the paper sheet 12, picked up from the plurality of paper sheets 12 in the tray 14 with the pick-up mechanism 16, in an upward direction in the inner space along a predetermined transfer path 18. In an upper wall of the outer housing 10 at a position corresponding to an upper end of the transfer path 18, an outlet opening 10*a* of the recording medium 10 is formed through which the paper sheet 12 ejected from the upper end of the transfer path 18 passes. On an upper surface of the upper wall of the outer housing 10, a tray 10*b* is formed on which the paper sheet 12 passed through the outlet opening 10*a* is stacked.

Further, in the inner space of the outer housing 10, an electrophotographic type image forming unit 22 is arranged at a predetermined position along the transfer path 18. The image forming unit 22 includes a photosensitive drum 22*a* which faces one of planar side surfaces of the paper sheet 12 being transferred in the transfer path 18, and is rotated in accordance with a transfer direction and a transfer speed of the paper sheet 18 in the transfer path 18.

The image forming unit 22 further includes a discharging device 22*b*, a charging device 22*c*, an exposing device 22*d* and a developing device 22*e* which are arranged along the external circumferential surface of the photosensitive drum 22*a* in this order in a rotation direction R of the photosensitive drum 22*a*.

The image forming unit 22 further includes a transfer device 22*f* and a separating device 22*g* arranged at two positions so that they face the external circumferential surface of the photosensitive drum 22*a* with the transfer path 18 interposed therebetween. The transfer device 22*f* is arranged on an upstream side than the separating device 22*g* in the rotation direction R of the photosensitive drum 22*a*. The image forming unit 22 further includes a fixing device 22*h* on a downstream side than the photosensitive drum 22*a* in the transfer direction of the paper sheet 12 in the transfer path 18.

The image forming unit 22 which is constituted as described above is provided with an operation controller 22*i* for controlling an operation of the image forming unit 22. The operation controller 22*i* is connected to an external data processing device (not shown) such as a personal computer or the like located outside of the image forming unit 22, and the controller 22*i* controls the operation of the image forming unit 22 on the basis of various operation control signal from the data processing device.

When the operation controller 22*i* receives an image formation start signal from the data processing device, the operation controller 22*i* makes the pick-up mechanism 16 pick up the upper most one paper sheet 12 from the tray 14, and makes a rotation of the photosensitive drum 22*a* stars at a predetermined speed in a predetermined rotation direction in correspondence to the pick-up of the paper sheet 12. At the same time, the operation controller 22*i* makes the discharging device 22*b* uniformly discharge the external circumferential surface of the photosensitive drum 22*a* being rotated, and makes the charging device 22*c* uniformly charge the external circumferential surface of the photosensitive drum 22*a* being rotated.

The exposing device 22*d* receives an image data signal from the data processing device through the operation controller 22*i*, and exposes the uniformly charged external circumferential surface of the photosensitive drum 22*a* in correspondence to the image data signal. Next, the developing device 22*e* develops the external circumferential surface of the photosensitive drum 22*a* with toner T to form a toner image at an exposed portion corresponding to the image data signal on the uniformly charged external circumferential surface.

The transfer unit 20 transfers the paper sheet 12 in the transfer path 18 such that an image formation start corresponding position on one plain side surface of the paper sheet 12, which corresponds to an image formation start position separated from the leading end on the other plain side surface of the sheet 12, faces the transfer device 22*f* when a leading end of the toner image on the external circumferential surface of the photosensitive drum 22*a* faces the transfer device 22*f*. Consequently, the transfer device 22*f* starts transferring the toner image on the external circumferential surface of the photosensitive drum 22*a* onto the other plain side surface (the image formation surface) of the paper sheet 12 at the image formation start position. Next, the separating device 22*g* separates the paper sheet 12 from the external circumferential surface of the photosensitive drum 22*a* while the toner image is held on the image formation surface on the paper sheet 12.

The paper sheet 12 separated from the external circumferential surface of the photosensitive drum 22*a* while holding the toner image is directed toward the fixing device 22*h* in the transfer path 18 by the transfer unit 20, and the fixing device 22*h* fixes the toner image onto the image formation surface of the paper sheet 12. The paper sheet 12 which has passed through the fixing device 22*h* is ejected from the upper end of the transfer path 18 onto the recording medium discharge tray lob on the upper surface of the upper wall of the outer housing 10 through the outlet opening 10*a* of the upper wall of the outer housing 10.

In the conventional printer which is constituted in the above-mentioned manner and is operated in the above described manner, each of the charging device 22*c*, the transfer device 22*f,* and the separating device 22*g* has a high voltage wire HVW respectively. With the application of a high voltage to the high voltage wire HVW, the wire HVW generates a corona discharge to make each of the devices 22*c,* 22*f,* and 22*g* operate as described above.

The corona discharge ionizes oxygen molecules in the air so that ozone is generated. Ozone is toxic to the above described various devices and other members in the outer housing 10 of the conventional printer described above, particularly to a photosensitive layer of the external circumferential surface of the photosensitive drum 22*a,* thereby decreasing the life of these devices and members.

The conventional printer described above has a heat discharging fan for discharging heat generated from the above described various devices and other members in the inner space of the outer housing 1 to the outside space, and the heat discharging fan conveys ozone to the outside space together with heated air in the inner space of the outer housing 10.

However, an efficiency by which the heat discharging fan discharges air largely decreases with an increase in a space volume in which the heat discharging fan tries to discharge air and with an increase in a distance from the heat discharging fan. In the conventional printer, the space from which the heat discharging fan tries to discharge air is a whole of the inner space of the outer housing 10, and the inner space is relatively large. Furthermore, it is impossible to install the heat discharging fan in the vicinity of the image forming apparatus 22 in the inner space because the inner space is relatively crowded with various parts in the outer housing 10 due to a recent trend whereby the external size of the apparatus is demanded to be smaller than the conventional one.

Consequently, in the conventional printer described above, ozone cannot be efficiently discharged out from the inner space of the outer housing to the outside and this fact hinders prolongation of the life of the conventional printer and the image forming apparatus. And in this connection, it is noted that it is extremely important to prolong the life of image forming apparatuses in order to avoid waste-disposal problems.

This invention has been derived from the above circumstances, and an object of the invention is to provide an image forming apparatus which can efficiently remove ozone without requiring an increase in the external size of the image forming apparatus, which generates a reduced amount of ozone, and which has a prolonged life.

BRIEF SUMMARY OF THE INVENTION

In order to achieve the above objects, an image forming apparatus according to the present invention comprises:

- an outer housing having an external communication opening;
- a recording medium transfer unit for transferring a recording medium from a lower portion of the outer housing to an upper portion thereof;
- an image forming unit, having a corona discharge member for conducting a corona discharge, for forming an image on the recording medium which is transferred with the transfer unit;
- a hollow air ejection passage body extending from the vicinity of the image forming unit to the external communication opening of the outer housing, and having an air inlet port which is opened in the vicinity of the image forming unit and an air ejection port which is opened at the external communication opening; and
- an air transferring device provided in the air ejection passage body for sucking air into the air ejection passage body through the air inlet port and ejecting air to the external communication opening of the outer housing from the air ejection port of the air ejection passage body.

In the image forming apparatus according to the present invention and characterized by being constituted in this manner, ozone generated in the corona discharge member of the image forming unit is sucked through the air inlet port which is opened in the vicinity of the image forming unit in the air ejection passage body into the air ejection passage body by the air transferring device provided in the hollow air ejection passage body. Furthermore, ozone sucked into the passage body is ejected from the air ejection port of the air ejection passage body to the air ejection opening of the outer housing. Since the air ejection passage body is extended from the vicinity of the image forming unit to the outside communication opening of the outer housing, ozone which is sucked into the air ejection passage body in the vicinity of the image forming unit does not spread out in the inner space of the outer housing from the air ejection passage body while the ozone is transferred to the external communication opening of the outer housing with the air transferring device.

Consequently, in the image forming apparatus in which ozone is generated, ozone can be efficiently removed without hindering to make the external size of the image forming apparatus being more smaller than that of the conventional one, and it is possible to prevent various above described devices and members in the inner space of the outer housing of the image forming apparatus from being damaged, so that the life of the image forming apparatus can be further prolonged.

In the image forming apparatus according to the present invention and constituted in the above described manner, preferably an ozone filter is provided in the air ejection passage body. As a consequence, this enables to prevent ozone from being ejected to the outside space from the outside communication opening of the outer housing.

In the image forming apparatus according to the present invention and constituted in the above described manner, preferably the air inlet port of the air ejection passage body is arranged under the corona discharge member of the image forming unit.

Ozone has a larger specific gravity than that of air, and ozone generated by the corona discharge member of the image forming unit moves downward with gravity. Consequently, when the air inlet port of the air ejection passage body is arranged under the corona discharge member of the image forming unit, ozone generated by the corona discharge member can be sucked into the air ejection passage body through the air inlet port of the air ejection passage body at a high efficiency.

In the image forming apparatus according to the present invention and constituted as described above, when the image forming unit has a photosensitive drum and forms an image with an electrophotographic method, the photosensitive drum is arranged adjacent to one side of a transfer track of the recording medium by the transfer unit, and the corona discharge member of the image forming unit is arranged adjacent to an external circumferential surface of the photosensitive drum on one side of the transfer track, it is preferable that the corona discharge member is arranged adjacent to the external circumferential surface of the photosensitive drum above a rotation center line of the photosensitive drum, and the air inlet port of the air ejection passage body is arranged below the rotation center line of the photosensitive drum and faces the external circumferential surface of the photosensitive drum along the rotation center line of the photosensitive drum on one side of the transfer track.

Since ozone having a larger specific gravity than that of air, moves downward with gravity after ozone is generated by the corona discharge member of the image forming unit, when the air inlet port of the air ejection passage member is also arranged under the corona discharge member of the image forming unit on one side of the transfer track, and the corona discharge member of the image forming unit is arranged adjacent to the external circumferential surface of the photosensitive drum on one side of the transfer track, ozone generated by the corona discharge member can be sucked into the air ejection passage body at a high efficiency through the air inlet port of the air ejection passage body.

Here, preferably, the air inlet port of the air ejection passage body is extended over an entire size in a direction along the rotation center line of the photosensitive drum on the external circumferential surface of the photosensitive drum. In such a structure, the external circumferential surface of the photosensitive drum which is particularly weak against ozone can be well protected from ozone.

In the image forming apparatus according to the present invention and constituted as described above, when the image forming unit includes a charging device for uniformly charging a whole of the external circumferential surface of the photosensitive drum, the charging device has a corona discharge member.

In the image forming apparatus according to the present invention and constituted as described above, when the image forming unit includes an exposing device for forming a desired electrostatic latent image by applying light to the external circumferential surface of the photosensitive drum for exposure, it is preferable that the image forming unit includes an exposure path through which light, applied to the external circumferential surface of the photosensitive drum from the exposing device, passes, the path being arranged below the rotation center line of the photosensitive drum and facing the external circumferential surface of the photosensitive drum along the rotation center line of the photosensitive drum. Further, the air inlet port of the air ejection passage body is arranged to face the exposure path.

In such structure, the air ejection passage body can be incorporated in the most compact manner to the electrophotographic type image forming unit in the outer housing.

In the image forming apparatus according to the present invention and constituted as described above, when the image forming unit has a photosensitive drum and forms an image with an electrophotographic method, the photosensitive drum is arranged adjacent to one side of a transfer track of the recording medium by the transfer unit, and the corona discharge member of the image forming unit is arranged on the other side of the transfer track, it is preferable that the corona discharge member is arranged adjacent to the external circumferential surface of the photosensitive drum approximately at the same level as that of the rotation center line of the photosensitive drum in the vertical direction or above the rotation center line, and the air inlet port of the air ejection passage body is arranged below the rotation center line of the photosensitive drum on the other side of the transfer track to face the external circumferential surface of the photosensitive drum along the rotation center line of the photosensitive drum.

Since ozone having a larger specific gravity than that of air, moves downward with gravity after ozone is generated by the corona discharge member of the image forming unit, when the corona discharge member of the image forming unit is arranged adjacent to the external circumferential surface of the photosensitive drum on the other side of the transfer track and the air inlet port of the air discharge member body is arranged under the corona discharge member of the image forming unit on the other side of the transfer track, ozone generated by the corona discharge member can be sucked into the air ejection passage body at a high efficiency through the air inlet port of the air ejection passage body.

In this case, it is preferable that the air inlet port of the air ejection passage body is extended over an entire size in a direction along the rotation center line of the photosensitive drum on the external circumferential surface of the photosensitive drum. In such a structure, the external circumferential surface of the photosensitive drum which is particularly weak against ozone can be well protected from ozone.

In the image forming apparatus according to the present invention and constituted as described above, when the image forming unit includes:

a charging device, arranged on one side of the transfer track, for uniformly charging the external circumferential surface of the photosensitive drum;

an exposing device for forming a desired electrostatic latent image by applying light to the external circumferential surface of the photosensitive drum which is uniformly charged with the charging device;

a developing device for developing with toner the electrostatic latent image exposed on the external circumferential surface of the photosensitive drum;

a toner image transfer device, arranged on the other side of the transfer track, for transferring a toner image developed from the latent image with toner on the external circumferential surface of the photosensitive drum to the recording medium which comes close to the outer circumferential surface of the photosensitive drum by the transfer unit; and a separating device, arranged on the other side of the transfer track, for separating the recording medium from the external circumferential surface of the photosensitive drum, on the recording medium the toner image having been transferred from the photosensitive drum, at least one of the transfer device or the separating device can have the corona discharge member.

In the image forming apparatus according to the present invention and constituted as described above, when the corona discharge member of the image forming unit is arranged on each of both sides of the transfer track of the recording medium by the transfer unit, it is preferable that the air inlet port of the air ejection passage body is also arranged under the corona discharge member on each of both sides of the transfer track.

Ozone has a larger specific gravity than that of air, and ozone generated by the corona discharge member of the image forming unit moves downward with gravity. Consequently, when the air inlet port of the air ejection passage body is arranged under the corona discharge member of the image forming unit on each of both sides of the transfer track, ozone generated by the corona discharge member can be sucked into the air ejection passage body through the air inlet port of the air ejection passage body at a high efficiency.

In the image forming apparatus according to the present invention and constituted as described above, when the image forming unit has a photosensitive drum and forms an image with an electrophotographic method, the photosensitive drum is arranged adjacent to one side of a transfer track of the recording medium by the transfer unit, and the corona discharge member is arranged on each of both sides of the transfer track in the image forming unit, it is preferable that the corona discharge member arranged on one side of the transfer track is arranged adjacent to the external circumferential surface of the photosensitive drum above a rotation center line of the photosensitive drum, the corona discharge member arranged on the other side of the transfer track is arranged approximately at the same level in the vertical direction as that of the rotation center line of the photosensitive drum or above the rotation center line of the photosensitive drum and faces to the external circumferential surface of the photosensitive drum, the air inlet port arranged on one side of the transfer track in the air ejection passage body is arranged below the rotation center line of the photosensitive drum to face the external circumferential surface of the photosensitive drum along the rotation center line of the photosensitive drum, and the air inlet port arranged on the other side of the transfer track in the air ejection passage body is arranged below the rotation center line of the photosensitive drum to face the external circumferential surface of the photosensitive drum along the rotation center line of the photosensitive drum.

Since ozone having a larger specific gravity than that of air moves downward with gravity after ozone is generated by the corona discharge member of the image forming unit, ozone generated by the corona discharge member arranged adjacent to the external circumferential surface of the photosensitive drum above the rotation center line of the photosensitive drum on one side of the transfer track is efficiently sucked into the air inlet port of the air ejection passage body arranged under the corona discharge member of the image forming unit on one side of the transfer track, and ozone generated by the corona discharge member arranged approximately at the same level in the vertical direction as that of the rotation center line of the photosensitive drum or above the rotation center line of the photosensitive drum on the other side of the transfer track to face the external circumferential surface of the photosensitive drum can be efficiently sucked into the air inlet port of the air ejection passage body arranged under the corona discharge member of the image forming unit on the other side of the transfer track.

In this constitution, it is preferable that the air inlet port of the air ejection passage body arranged on each of both sides of the transfer track is extended over the entire size in a direction along the rotation center line of the photosensitive drum on the external circumferential surface of the photosensitive drum. In such a structure, the external circumferential surface of the photosensitive drum which is particularly weak against ozone can be well protected from ozone.

In the image forming apparatus according to the present invention and constituted as described above, when the image forming unit includes:

a charging device, arranged on one side of the transfer track, for uniformly charging the external circumferential surface of the photosensitive drum;

an exposing device for forming a desired electrostatic latent image by applying light to the external circumferential surface of the photosensitive drum which is uniformly charged with the charging device;

a developing device for developing with toner the electrostatic latent image exposed on the external circumferential surface of the photosensitive drum with the toner;

a toner image transfer device, arranged on the other side of the transfer track, for transferring a toner image developed from the latent image with toner on the external circumferential surface of the photosensitive drum to the recording medium which comes close to the outer circumferential surface of the photosensitive drum by the transfer unit; and a separating device, arranged on the other side of the transfer track, for separating the recording medium from the external circumferential surface of the photosensitive drum, on the recording medium the toner image having been transferred from the photosensitive drum, the charging device can have the corona discharge member and at least one of the transfer device and the separating device can have the corona discharge member.

Also, in the image forming apparatus according to the present invention and constituted as described above, it is preferable that the image forming unit includes an exposure path through which light, applied to the external circumferential surface of the photosensitive drum from the exposing device, passes the path being arranged below the rotation center line of the photosensitive drum and facing the external circumferential surface of the photosensitive drum along the rotation center line of the photosensitive drum, and the air inlet port arranged on one side of the transfer track in the air ejection passage body is arranged to face the exposure path.

In such a structure, the air ejection passage body can be incorporated in the most compact manner in the electrophotographic image forming unit in the outer housing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

Figure 1:
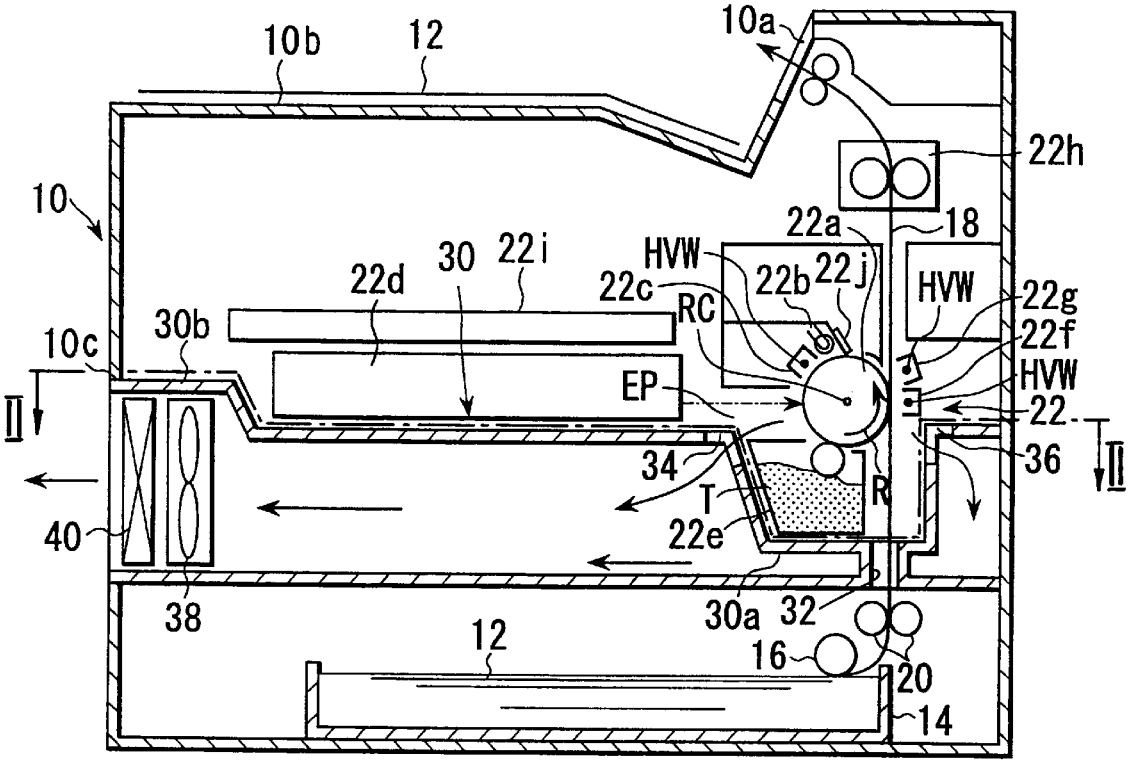
FIG. 1 is a schematic vertical sectional view of a printer according to one embodiment of an image forming apparatus of the present invention.
Figure 2:
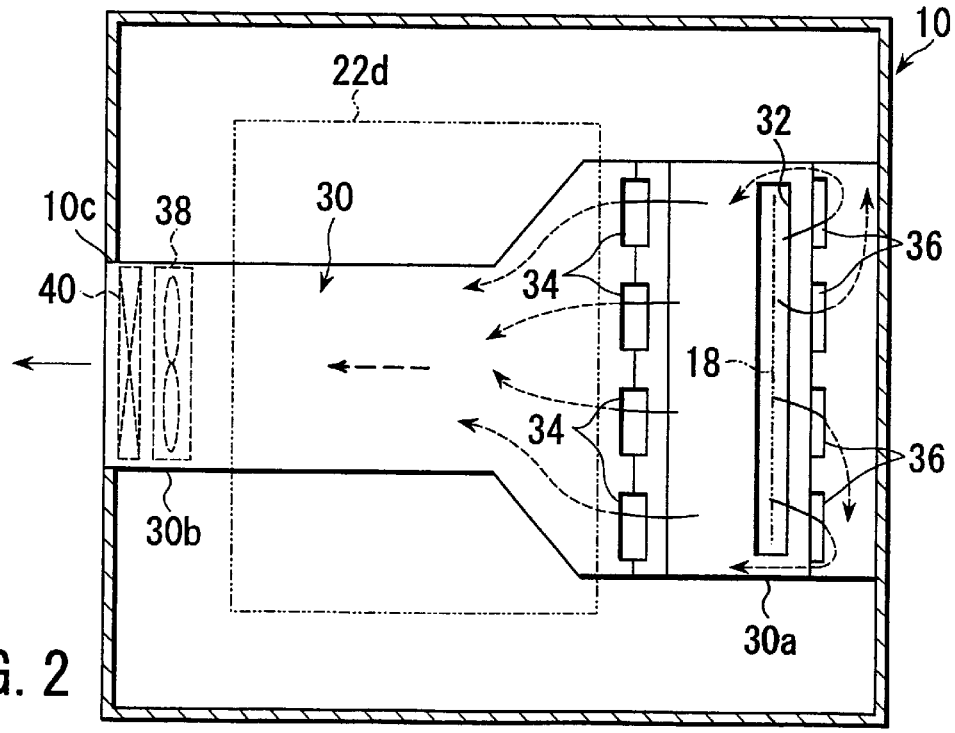
FIG. 2 is a schematic horizontal sectional view taken along line II—II of the printer of FIG. 1.
Figure 3:
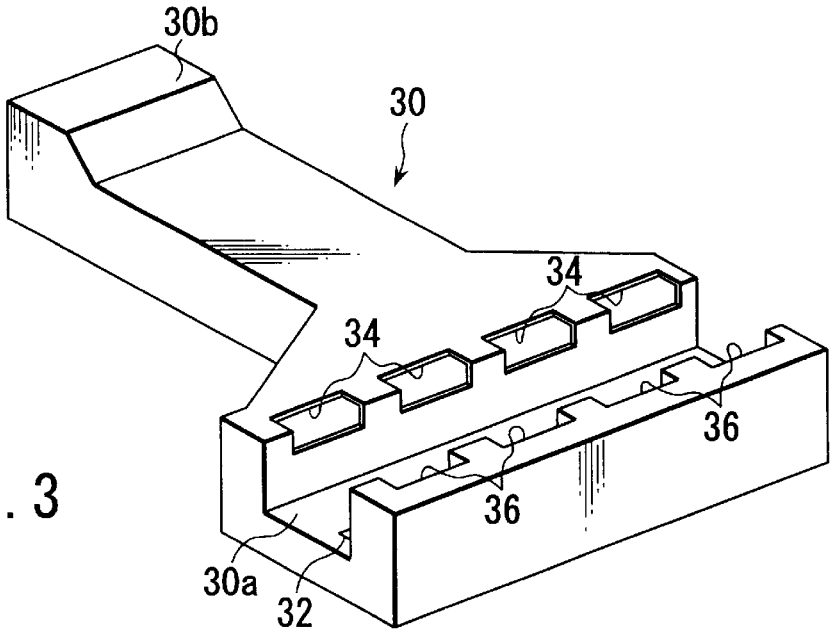
FIG. 3 is an enlarged perspective view of an air ejection passage body of the printer.

Hereinafter, the printer according to one embodiment of the image forming apparatus of the present invention will be explained in detail by referring to FIGS. 1 through 3.

DETAILED DESCRIPTION OF THE INVENTION

A basic structure of the printer according one embodiment of this invention is the same as a basic structure of the printer constituted of the conventional image forming apparatus described above with reference to FIG. 4. In FIG. 1 through FIG. 3 showing the printer according to one embodiment of the image forming apparatus of this invention, constituent members which are the same as those of the conventional printer are denoted by the same reference numerals as those denoting the constituent members of the conventional printer of FIG. 4, which correspond to the constituent members of the present invention, and a detailed explanation thereof will be omitted.

In this embodiment, the image forming unit 22 has a cleaner 22*j* adjacent to an upstream side of the discharging device 22*b* in a predetermined rotation direction R of the photosensitive drum 22*a* along the external circumferential surface of the photosensitive drum 22*a*. The cleaner 22*j* removes toner deposited on the external circumferential surface of the photosensitive drum 22*a*.

When an arrangement of a plurality of constituent devices or members of the image forming unit 22 in the outer housing 10 is explained by referencing the transfer track (corresponding to the transfer path 18) of the recording medium 12 which is transferred in the transfer path 18 with the transfer unit 20 from the lower tray 14 in the inner space of the outer housing 10 to the outlet opening 10*a* of the upper wall of the outer housing 10, the photosensitive drum 22*a* is arranged on one side of the transfer track.

The external circumferential surface of the photosensitive drum 22*a* is located adjacent to the transfer track. Furthermore, around the external circumferential surface of the photosensitive drum 22*a* on one side of the transfer track, the cleaner 22*j*, the discharging device 22*b*, the charging device 22*c*, the exposing device 22*d*, and the developing device 22*e* are arranged in this order in the predetermined rotation direction R of the photosensitive drum 22*a*.

The cleaner 22*j*, the discharging device 22*b*, the charging device 22*c*, and the developing device 22*e* are arranged adjacent to the external circumferential surface of the photosensitive drum 22*a*, and the exposing device 22*d* is arranged at a position separated by a certain distance from the external circumferential surface of the photosensitive drum 22*a*. Since the exposing device 22*d* is larger than each of the cleaner 22*j*, the discharging device 22*b*, the charging device 22*c*, and the developing device 22*e*, by arranging the exposing device 22*d* as described above, it is possible to make the image forming unit 22 compact without interference of the exposing device 22*d* with the cleaner 22*j*, the discharging device 22*b*, the charging device 22*c*, and the developing device 22*e*. The cleaner 22*j*, the discharging device 22*b*, the charging device 22*c*, and the developing device 22*e* are constituted as an integrated block. An exposure path EP is set between the charging device 22*c* and the developing device 22*e* around the external circumferential surface of the photosensitive drum 22*a*, and the exposure path EP allows light applied from the exposing device 22*d* toward the external circumferential surface of the photosensitive drum 22*a* to reach at the external circumferential surface of the photosensitive drum 22*a*. (In this embodiment, the light from the exposing device 22*d* is a laser beam and is denoted by an arrow of a two-dots chain line in FIG. 1.)

On the other side of the above described transfer track, the transfer device 22*f* and the separating device 22*g* are arranged in this order along the predetermined rotation direction R of the photosensitive drum 22*a* and to face the external circumferential surface of the photosensitive drum 22*a*. The transfer device 22*f* is located adjacent to the external circumferential surface of the photosensitive drum 22*a*, and the separating device 22*g* is separated in a certain distance from the external circumferential surface of the photosensitive drum 22*g*.

Next, when the arrangement of a plurality of constituent devices or members of the image forming unit 22 is explained by referencing the rotation center line RC of the photosensitive drum 22*a*, the cleaner 22*j*, the discharging device 22*b*, and the charging device 22*c* are arranged above the rotation center line RC on one side of the above described transfer track, the exposing device 22*d* and the exposure path EP are located at approximately the same level as that of the rotation center line RC in the vertical direction, and the developing device 22*e* is located below the rotation center line RC. On the other side of the above described transfer track, the transfer device 22*f* is arranged at approximately the same level as that of the rotation center line RC and the separating device 22*g* is arranged above the rotation center line RC.

In this embodiment, the charging device 22*c* located above the rotation center line RC on one side of the transfer track around the external circumferential surface of the photosensitive drum 22*a*, and the transfer device 22*f* located at approximately the same level as that of the rotation center line RC and the separating device 22*g* located above the rotation center line RC on the other side of the transfer track around the external circumferential surface of the photosensitive drum 22*a* have high voltage wire HVW respectively. The high voltage wire HVW extends in the same direction as the rotation center line RC in parallel to the rotation center line RC of the photosensitive drum 22*a* and extends in an equal distance to the entire size of the external circumferential surface of the photosensitive drum 22*a* in the same direction as the rotation center line RC.

Figure 4:
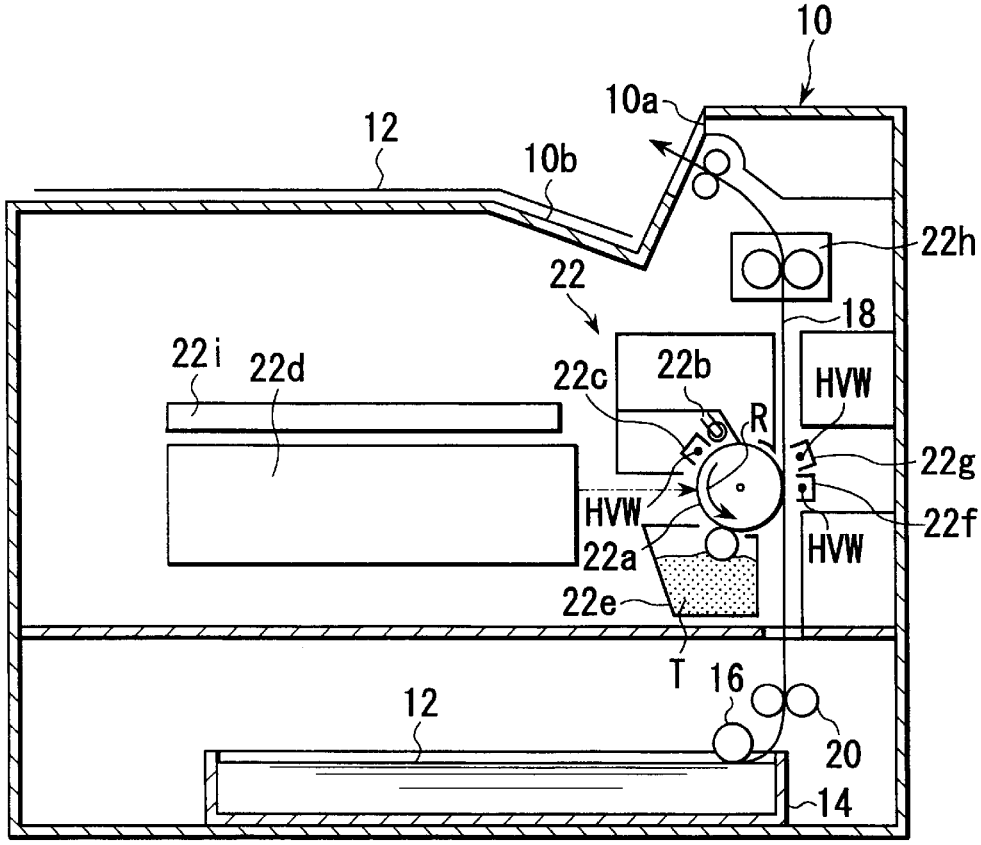
FIG. 4 (PRIOR ART)
FIG. 4 is a schematic vertical sectional view of a printer constituted of a conventional image forming apparatus.

A difference of the image forming apparatus according to the present invention from the above described conventional image forming device shown in FIG. 4 is that an air ejection passage body 30 is provided between the image forming unit 22 and the recording medium cassette 14 in the outer housing 10. The air ejection passage body 30 is hollow, is extended from a position located under the image forming unit 22 to an air ejection opening 10*c* (external communication opening) formed on a predetermined position of side walls of the outer housing 10, and is connected to the air ejection opening 10*c*. The predetermined position is set to a surface (rear surface) facing a direction opposite to a surface (front surface) normally directed to users when the image forming apparatus according to the embodiment is used.

One end portion 30*a* located under the image forming unit 22 in the air ejection passage body 30 is provided with a transfer path passage opening 32 for allowing the transfer path 18 to pass therethrough. The one end portion 30*a* further comprises first air inlet ports 34 at a position located adjacent to the exposure path EP of the image forming unit 22 and facing the exposure path EP on one side of the transfer path 18. The one end portion 30*a* further comprises second air inlet ports 36 at a position location adjacent to the transfer device 22*f* and the separating device 22*g* of the image forming unit 22 and facing them on the other side of the transfer path 18.

The first air inlet ports 34 and the second air inlet ports 36 are respectively extended in the same direction as that of the rotation center line CR in parallel to the rotation center line CR of the photosensitive drum 22*a* and are extended over the entire size of the external circumferential surface of the photosensitive drum 22*a* in the same direction as that of the rotation center line CR.

The other end portion 30*b* connected to the air ejection opening 10*c* of the outer housing 10 in the air ejection passage body 30 is provided with an air transferring device 38 and an ozone filter 40. In this embodiment, the air transferring device 38 is constituted of an air discharge fan.

The air ejection passage body 30 constituted as described above operates the air transferring device 38 while the image forming unit 22 is operated for the image formation. The air transferring device 38 forms in the inner space of the air ejection passage body 30 an air stream which is directed from the first and the second air inlet ports 34 and 36 of one end portion 30*a* located under the image forming unit 22 to the other end portion 30*b* connected to the air ejection opening 10*c* of the outer housing 10.

While the image forming unit 22 is operated for the image formation, the high voltage wires HVW incorporated in the charging device 22*c* located above the rotation center line RC on one side of the transfer track (the transfer path 18), the transfer device 22*f* located at approximately the same level in the vertical direction as that of the rotation center line RC and the separating device 22*g* located above the rotation center line RC on the other side of the transfer track (the transfer path 18) conduct the corona discharge and generate ozone. Since ozone is heavier in gravity than air, ozone goes down along the external circumferential surface of the photosensitive drum 22*a* and reaches at the vicinity of the first air inlet ports 34 and the second air inlet ports 36 of the air ejection passage body 30. Ozone is sucked into the inner space of the air ejection passage body 30 through the first air inlet ports 34 and the second air inlet ports 36 by an air stream formed in the inner space of the air ejection passage body with the air transferring device 38, so that the ozone is trapped with the ozone filter 40 after ozone is transferred in the inner space of the air ejection passage body 30. Thus, no ozone is ejected from the air ejection opening 10*b* of the outer housing 10. Furthermore, since no ozone sucked into the air ejection passage body 30 is leaked from the air ejection passage body 30 to the inner space of the outer housing 10, various devices and members in the inner space of the outer housing 10 is not contaminated with ozone.

The first air inlet ports 34 and the second air inlet ports 36, which are extended in the same direction as that of the rotation center line CR in parallel to the rotation center line CR of the photosensitive drum 22*a* and which are extended over the entire size of the external circumferential surface of the photosensitive drum 22*a* in the same direction as that of the rotation center line CR of the photosensitive drum 22*a*, can efficiently trap ozone generated on both sides of the transfer track (the transfer path 18).

In the above described embodiment, since the image forming unit 22 includes ozone generating members (namely, the high voltage wires HVW of the charging device 22*c*, the transfer device 22*f*, and the separating device 22*g* ) on both sides of the transfer track (the transfer path 18), the one end portion 30*a* of the air ejection passage body 30 located under the image forming unit 22 also has the first and second air inlet ports 34 and 36 for sucking ozone at positions under the ozone generating members on both sides of the transfer track (the transfer path 18). However, when the image forming unit 22 includes the ozone generating member (s) (the high voltage wire HVW of the charging device 22*c* or the high voltage wires HBW of the transfer device 22*f* and the separating device 22*g*) only on any one side of the transfer track (the transfer path 18), one end portion 30*a* of the air ejection passage body 30 located under the image forming unit 22 may only have any one of the group of the first air inlet ports 34 and the group of the second air inlet ports 36 for sucking ozone under the ozone generating member on any one of the both sides of the transfer track (the transfer path 18). On the other side of the both sides of the transfer track (the transfer path 18) which does not have the ozone generating member, the other one of the group of the first air inlet ports 34 and the group of the second air inlet ports 36 can be omitted.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an outer housing having an external communication opening;

a recording medium transfer unit which transfers a recording medium from a lower portion of the outer housing to an upper portion thereof;

an image forming unit which comprises at least one corona discharge member, and which forms an image on the recording medium transferred by the transfer unit;

a hollow air ejection passage body which is formed independently of the outer housing, which extends at a height level below the corona discharge member from a vicinity of the image forming unit to the external communication opening of the outer housing, and which comprises at least one air inlet port opened in a vicinity of and under the at least one corona discharge member and an air ejection port opened at the external communication opening; and an air transferring device which is provided in the air ejection passage body, and which sucks air into the air ejection passage body through the at least one air inlet port and ejects air to the external communication opening of the outer housing from the air ejection port of the air ejection passage body.

2. An image forming apparatus according to claim 1, wherein:

ozone generated by the at least one corona discharge member of the image forming unit is sucked into the air ejection passage body through the at least one air inlet port, and the air ejection passage body is provided with an ozone filter which adsorbs the ozone.

3. An image forming apparatus according to claim 1, wherein:

the image forming unit includes a photosensitive drum and forms an image by an electrophotographic method, the photosensitive drum is arranged on a first side of a transfer track of the recording medium and is adjacent to the transfer track, the at least one corona discharge member of the image forming unit is arranged on the first side of the transfer track such that the at least one corona discharge member is adjacent to an external circumferential surface of the photosensitive drum and above a rotation center line of the photosensitive drum, and the air ejection passage body comprises a plurality of air inlet ports arranged on the first side of the transfer track below the rotation center line of the photosensitive drum, facing the external circumferential surface of the photosensitive drum and extending along the rotation center line of the photosensitive drum.

4. An image forming apparatus according to claim 3, wherein the air inlet ports of the air ejection passage body are extended over an entire length of the external circumferential surface of the photosensitive drum in a direction along the rotation center line of the photosensitive drum.

5. An image forming apparatus according to claim 3, wherein:

the image forming unit includes a charging device which uniformly charges the external circumferential surface of the photosensitive drum, and the charging device comprises one of the at least one corona discharge member.

6. An image forming apparatus according to claim 3, wherein:

the image forming unit includes an exposing device which applies light to the external circumferential surface of the photosensitive drum and which forms a desired electrostatic latent image on the external circumferential surface of the photosensitive drum, and an exposure path through which the light applied to the external circumferential surface of the photosensitive drum passes, the exposure path is arranged below the rotation center line of the photosensitive drum and facing the external circumferential surface of the photosensitive drum along the rotation center line of the photosensitive drum, and the air inlet ports of the air ejection passage body face the exposure path.

7. An image forming apparatus according to claim 1, wherein:

the image forming unit includes a photosensitive drum and forms an image by an electrophotographic method, the photosensitive drum is arranged on a first side of a transfer track of the recording medium and is adjacent to the transfer track, the at least one corona discharge member of the image forming unit is arranged on a second side of the transfer track such that the at least one corona discharge member is adjacent to an external circumferential surface of the photosensitive drum and above a rotation center line of the photosensitive drum, and the air ejection passage body comprises a plurality of air inlet ports arranged on the second side of the transfer track below the rotation center line of the photosensitive drum, facing the external circumferential surface of the photosensitive drum and extending along the rotation center line of the photosensitive drum.

8. An image forming apparatus according to claim 7, wherein the air inlet ports of the air ejection passage body are extended over an entire length of the external circumferential surface of the photosensitive drum in a direction along the rotation center line of the photosensitive drum.

9. An image forming apparatus according to claim 7, wherein the image forming unit includes:

a charging device which is arranged on the first side of the transfer track and which uniformly charges the external circumferential surface of the photosensitive drum;

an exposing device which applies light to the external circumferential surface of the photosensitive drum uniformly charged by the charging device, and which forms a desired electrostatic latent image on the external circumferential surface of the photosensitive drum;

a developing device which develops by toner the electrostatic latent image exposed on the external circumferential surface of the photosensitive drum;

a toner image transfer device which is arranged on the second side of the transfer track and which transfers a toner image developed on the external circumferential surface of the photosensitive drum to the recording medium; and a separating device which is arranged on the second side of the transfer track and which separates the recording medium from the external circumferential surface of the photosensitive drum after the toner image has been transferred from the photosensitive drum to the recording medium, and wherein at least one of the transfer device and the separating device comprises one of the at least one corona discharge member.

10. An image forming apparatus according to claim 1, wherein:

the image forming unit comprises a plurality of corona discharge members, the corona discharge members are arranged on both first and second sides of a transfer track of the recording medium, the air ejection passage body comprises a plurality of air inlet ports, and the air inlet ports are arranged under the corona discharge members on both the first and second sides of the transfer track.

11. An image forming apparatus according to claim 10, wherein:

the image forming unit includes a photosensitive drum and forms an image by an electrophotographic method, the photosensitive drum is arranged on the first side of the transfer track of the recording medium and is located adjacent to the transfer track, the corona discharge members arranged on the first side of the transfer track are located adjacent to the external circumferential surface of the photosensitive drum above a rotation center line of the photosensitive drum, the air inlet ports arranged on the first side of the transfer track face the external circumferential surface of the photosensitive drum and extend along the rotation center line of the photosensitive drum below the center line of rotation of the photosensitive drum, the corona discharge members arranged on the second side of the transfer track face the external circumferential surface of the photosensitive drum and are located at or above a level of the rotation center line of the photosensitive drum in a vertical direction, and the air inlet ports arranged on the second side of the transfer track are located below the rotation center line of the photosensitive drum, and face the external circumferential surface of the photosensitive drum and extend along the rotation center line of the photosensitive drum.

12. An image forming apparatus according to claim 11, wherein the air inlet ports on both the first and second sides of the transfer track extend over an entire length of the external circumferential surface of the photosensitive drum in a direction along the rotation center line of the photosensitive drum.

13. An image forming apparatus according to claim 12, wherein the image forming unit includes:

a charging device which is arranged on the first side of the transfer track and which uniformly charges the external circumferential surface of the photosensitive drum;

an exposing device which applies light to the external circumferential surface of the photosensitive drum uniformly charged by the charging device, and which forms a desired electrostatic latent image on the external circumferential surface of the photosensitive drum;

a developing device which develops by toner the electrostatic latent image exposed on the external circumferential surface of the photosensitive drum;

a toner image transfer device which is arranged on the second side of the transfer track and which transfers a toner image developed on the external circumferential surface of the photosensitive drum to the recording medium; and a separating device which is arranged on the second side of the transfer track and which separates the recording medium from the external circumferential surface of the photosensitive drum after the toner image has been transferred from the photosensitive drum to the recording medium, and wherein the charging device comprises one of the corona discharge members, and at least one of the transfer device and the separating device comprise one of the corona discharge members.

14. An image forming apparatus according to claim 11, wherein:

the image forming unit includes an exposing device which applies light to the external circumferential surface of the photosensitive drum and which forms a desired electrostatic latent image on the outer circumferential surface of the photosensitive drum, and an exposure path through which the light applied to the external circumferential surface of the photosensitive drum passes, the path is arranged below the rotation center line of the photosensitive drum and faces the external circumferential surface of the photosensitive drum along the rotation center line of the photosensitive drum, and the air inlet ports arranged on the first side of the transfer track of the air ejection passage body face the exposure path.

15. An image forming apparatus comprising:

an outer housing having an air escape opening;

a recording medium conveying unit which conveys a recording medium from a lower portion of the outer housing to an upper portion thereof;

an image forming unit which comprises at least one corona discharge member, and which forms an image on the recording medium conveyed by the conveying unit;

a hollow air ejection passage body which is formed independently of the outer housing, which extends at a height level below the corona discharge member from a vicinity of the image forming unit to the air escape opening, and which comprises at least one air inlet port opened in a vicinity of and under the at least one corona discharge member and an air ejection port opened at the air escape opening; and an air conducting device which is provided in the air ejection passage body, and which conducts air in a vicinity of the image forming unit to the air ejection port from the at least one air inlet port and allows air to escape from the air escape opening of the outer housing.

16. The image forming apparatus according to claim 15, wherein the air ejection passage body is provided with an ozone filter which adsorbs ozone discharged by the at least one corona discharge member.

17. The image forming apparatus according to claim 15, wherein the at least one air inlet port comprises a group of air inlet ports arranged under the at least one corona discharge member.

18. The image forming apparatus according to claim 15, wherein:

the image forming unit comprises a photosensitive drum and forms an image by an electrophotographic method, the photosensitive drum is arranged adjacent to a first side of a conveying path of the recording medium conveyed by the conveying unit, the at least one corona discharge member is arranged adjacent to an external circumferential surface of the photosensitive drum on the first side of the conveying path, and the air ejection passage body comprises a group of air inlet ports arranged under the at least one corona discharge member and facing the external circumferential surface of the photosensitive drum on the first side of the conveying path.

19. The image forming apparatus according to claim 18, wherein the air ejection passage body comprises a group of air inlet ports which are arranged over an entire length of the external circumferential surface of the photosensitive drum in a direction along a rotation center line of the photosensitive drum.

20. The image forming apparatus according to claim 18, wherein the at least one corona discharge member uniformly charges the external circumferential surface of the photosensitive drum.

21. The image forming apparatus according to claim 18, wherein:

the image forming unit includes an exposing device which applies light to the external circumferential surface of the photosensitive drum and which forms an electrostatic latent image on the external circumferential surface of the photosensitive drum, and an exposure path through which the light applied to the external circumferential surface of the photosensitive drum passes, and the air ejection passage body comprises a group of air inlet ports arranged to face the exposure path.

22. The image forming apparatus according to claim 18, wherein the air ejection passage body is provided with an ozone filter which adsorbs ozone discharged by the at least one corona discharge member.

23. The image forming apparatus according to claim 15, wherein:

the image forming unit comprises a photosensitive drum and forms an image by an electrophotographic method, the photosensitive drum is arranged adjacent to a first side of a conveying path of the recording medium conveyed by the conveying unit, the at least one corona discharge member is arranged adjacent to an external circumferential surface of the photosensitive drum on a second side of the conveying path, and the air ejection passage body comprises a group of air inlet ports arranged below the at least one corona discharge member and facing the external circumferential surface of the photosensitive drum on the second side of the conveying path.

24. The image forming apparatus according to claim 23, wherein the air ejection passage body comprises a group of air inlet ports which are arranged over an entire length of the external circumferential surface of the photosensitive drum in a direction along a rotation center line of the photosensitive drum.

25. The image forming apparatus according to claim 23, wherein the image forming unit includes:

a toner image transfer device which is arranged on the second side of the conveying path and which transfers a toner image formed on the photosensitive drum onto the recording medium; and a separating device which is arranged on the second side of the conveying path and which separates the recording medium from the photosensitive drum, and wherein at least one of the transfer device and the separating device comprises the at least one corona discharge member.

26. The image forming apparatus according to claim 23, wherein the air ejection passage body is provided with an ozone filter which adsorbs ozone discharged by the at least one corona discharge member.

* * * * *